US007433626B2

(12) United States Patent
Takeuchi

(10) Patent No.: US 7,433,626 B2
(45) Date of Patent: Oct. 7, 2008

(54) IMAGE FORMING APPARATUS FEATURING DIFFERENT VOLTAGES FOR COLLECTING AND TRANSFERRING TONER FROM A CLEANING MEMBER

(75) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/692,559

(22) Filed: Mar. 28, 2007

(65) Prior Publication Data

US 2007/0230993 A1 Oct. 4, 2007

(30) Foreign Application Priority Data

Mar. 31, 2006 (JP) ..... 2006-099949

(51) Int. Cl.
*G03G 15/16* (2006.01)

(52) U.S. Cl. ..... 399/101

(58) Field of Classification Search ..... 399/101, 399/149, 150, 259, 354
See application file for complete search history.

(56) References Cited

U.S. PATENT DOCUMENTS

| | | | | |
|---|---|---|---|---|
| 7,242,887 | B2 | 7/2007 | Takeuchi et al. | 399/101 |
| 2005/0078972 | A1 * | 4/2005 | Soda et al. | 399/101 |
| 2007/0183801 | A1 | 8/2007 | Takeuchi et al. | 399/49 |

FOREIGN PATENT DOCUMENTS

| | | | | |
|---|---|---|---|---|
| JP | 10-333514 | A | | 12/1998 |
| JP | 2000-162894 | A | | 6/2000 |
| JP | 2002-072697 | A | | 3/2002 |
| JP | 2002-207403 | A | | 7/2002 |
| JP | 2004045688 | A | * | 2/2004 |
| JP | 2004102018 | A | * | 4/2004 |
| JP | 2004-252320 | A | | 9/2004 |

* cited by examiner

*Primary Examiner*—Ryan Gleitz
(74) *Attorney, Agent, or Firm*—Fitzpatrick, Cella, Harper & Scinto

(57) ABSTRACT

An image forming apparatus includes a rotatable image bearing member for bearing a toner image, a toner image forming member for forming the toner image, a transfer member for transferring the toner image onto a transfer material, and a cleaning member for electrostatically collecting toner remaining on the image bearing member after the toner image is transferred onto the transfer material by being supplied from the power source a voltage which has an absolute value smaller than an absolute value of an electrical discharge start voltage and a preset polarity. The image forming apparatus is capable of executing a toner discharge mode for discharging toner from the cleaning member by applying, from the power source to the cleaning member, a voltage which has an absolute value equal to or larger than the absolute value of the electrical discharge start voltage and an identical polarity to the preset polarity.

8 Claims, 8 Drawing Sheets

IMAGE FORMING APPARATUS FEATURING DIFFERENT VOLTAGES FOR COLLECTING AND TRANSFERRING TONER FROM A CLEANING MEMBER

FIELD OF THE INVENTION AND RELATED ART

The present invention relates to an image forming apparatus for collecting a toner from an image carrying member by using a cleaning member to which a bias voltage is applied and an image forming apparatus for collecting a toner from a transfer member by using a cleaning member to which a bias voltage is applied. More specifically, the present invention relates to a removing method of removing a toner accumulated on a cleaning member.

By an electrostatically photographic process using an intermediary transfer belt, an image forming apparatus for forming a color image on a recording material has been put into practical use. In such an image forming apparatus, e.g., toner images of cyan, magenta, yellow, and black which are independently formed on a photosensitive drum are successively primary-transferred onto the intermediary transfer belt in a superposition manner. Then, four-color toner images are finally secondary-transferred from the intermediary transfer belt onto the recording material.

The image forming apparatus using the intermediary transfer belt requires a cleaning apparatus for removing a secondary transfer residual toner on the intermediary transfer belt at a position between a secondary transfer position and a primary transfer position of the intermediary transfer belt. This is because when the secondary transfer residual toner remaining on the intermediary transfer belt is mixed with a toner image to be primary-transferred in a subsequent primary transfer step, color mixing is caused to occur to lower an image quality.

As such a cleaning apparatus, a cleaning apparatus of the type wherein the secondary transfer residual toner is electrostatically absorbed by causing a brush member supplied with a bias voltage to rotationally rub the intermediary transfer belt. According to the cleaning apparatus of this type, a pressure or a frictional force with respect to cleaning is very small, so that movement of the intermediary transfer belt is stabilized.

In the cleaning apparatus using the brush member, there is no problem about a cleaning ability at an initial stage using a fresh brush member However, with the passage of time, a toner is accumulate on the brush member, so that an amount of a toner moved from the brush member to the intermediary transfer belt against the bias voltage is increased. As a result, a cleaning performance is gradually lowered.

In view of this problem, a method of removing the toner accumulated on the brush member by causing a metal roller, to be supplied with a voltage, to contact the brush member has been proposed (Japanese Laid-Open Patent Application (JP-A) 2002-207403).

However, the toner collected or removed by the brush member contacting the intermediary transfer belt (member) contains toner particles having a very small charge amount. These toner particles cannot be removed by the metal roller to be supplied with a voltage, so that they are accumulated on or in the brush member, thus leading to a lowering in cleaning performance.

Further, in order to alleviate deposition of the toner on a back surface of the recording material having a surface onto which the toner image is transferred, a cleaning apparatus is provided to a transfer roller for transferring a toner image onto the recording material in contact with the intermediary transfer belt in some cases. Also in the case where such a constitution that a metal roller is caused to contact the brush member of the cleaning apparatus provided to the transfer roller is employed, the above described problem has arisen.

SUMMARY OF THE INVENTION

A principal object of the present invention is to provide an image forming apparatus capable of removing a toner, with a small amount of electric charge, from a cleaning member.

According to an aspect of the present invention, there is provided an image forming apparatus comprising:

an image carrying member for carrying a toner image;

toner image forming means for forming the toner image on the image carrying member;

transfer means for transferring the toner image formed on the image carrying member onto a recording material;

a cleaning member for electrostatically collecting a toner remaining on the image carrying member after the toner image is transferred onto the recording material; and a power source for applying a voltage having an absolute value less than that of an electric discharge start voltage to the cleaning member so that the cleaning member collects the toner from the image carrying member and for applying a voltage having an absolute value equal to or more than that of the electric discharge start voltage to the cleaning member so that a toner accumulated on the cleaning member is moved to the image carrying member.

According to another aspect of the present invention, there is provided an image forming apparatus comprising:

an image carrying member for carrying a toner image;

a transfer member, pressed against and image carrying member to form a nip between the transfer member and the image carrying member for transferring the toner image formed on the image carrying member onto a recording material nipped in the nip;

a cleaning member for electrostatically collecting a toner deposited on the transfer member; and a power source for applying a voltage having an absolute value less than that of an electric discharge start voltage to the cleaning member so that the cleaning member collects the toner from the image carrying member and for applying a voltage having an absolute value equal to or more than that of the electric discharge start voltage to the cleaning member so that a toner accumulated on the cleaning member is moved to the transfer member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, a color copying machine as an embodiment of the image forming apparatus according to the present invention will be described in detail with reference to the drawings. The image forming apparatus of the present invention is not limited to restrictive constitutions in embodiments described below. The image forming apparatus of the present invention is also practiceable in other embodiments in which a part or all of the constitutions of the embodiments described below are replaced with alternative constitutions so long as a transfer residual toner remaining on a image carrying member is electrostatically removed.

The image forming apparatus of the present invention can also be carried out as a mechanism for cleaning, e.g., a particular image carrying member (in Second Embodiment or the like), on which an unnecessary toner is deposited by rotation in contact with an ordinary image carrying member, other than the ordinary image carrying member such as a photosensitive drum or an intermediary transfer belt.

Incidentally, a part of schematic illustration and detailed explanation of general structures, materials, control and operation method, and the like of conventional image forming apparatuses as described in JP-A 2002-207403 and JP-A 2002-72697 will be omitted from the following description.

First Embodiment

Figure 1:
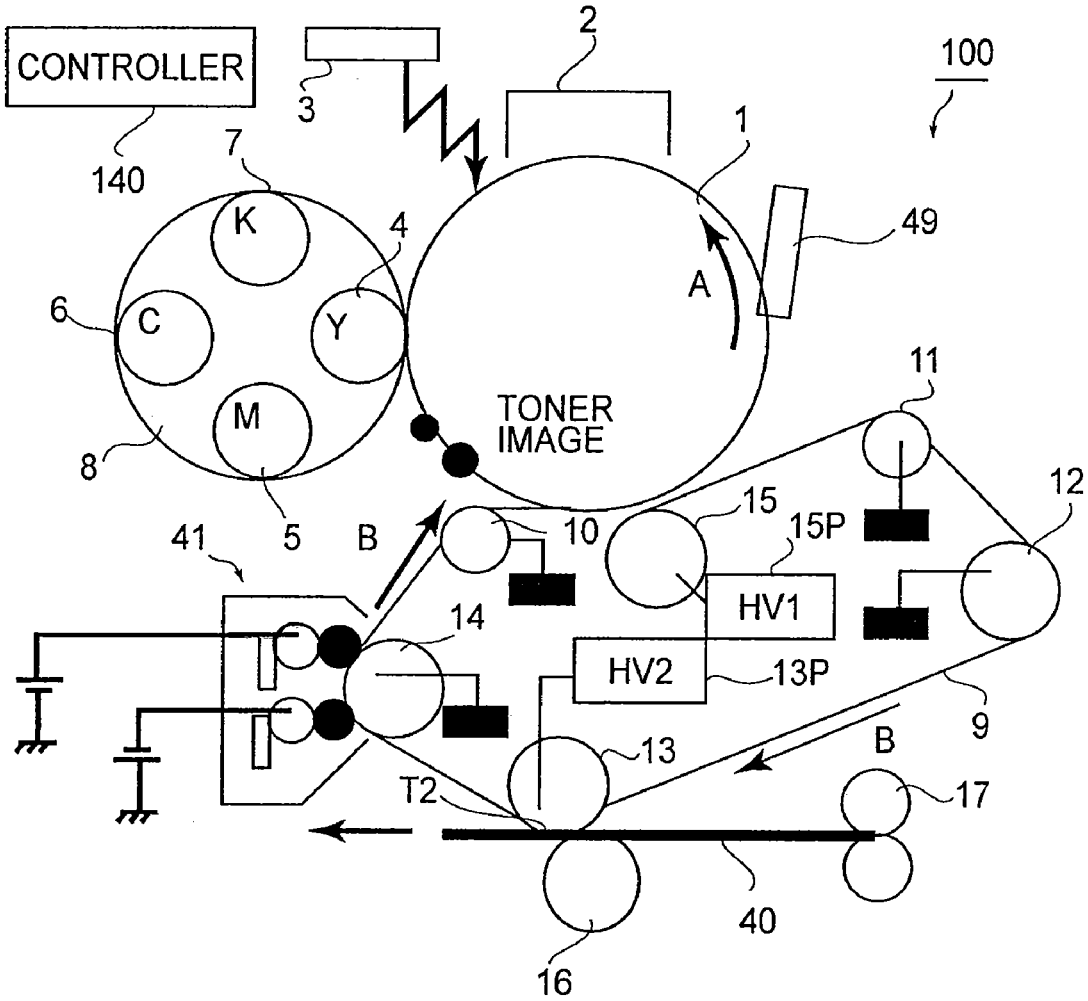
FIG. 1 is a schematic view for illustrating a constitution of an image forming apparatus according to First Embodiment of the present invention.
Figure 2:
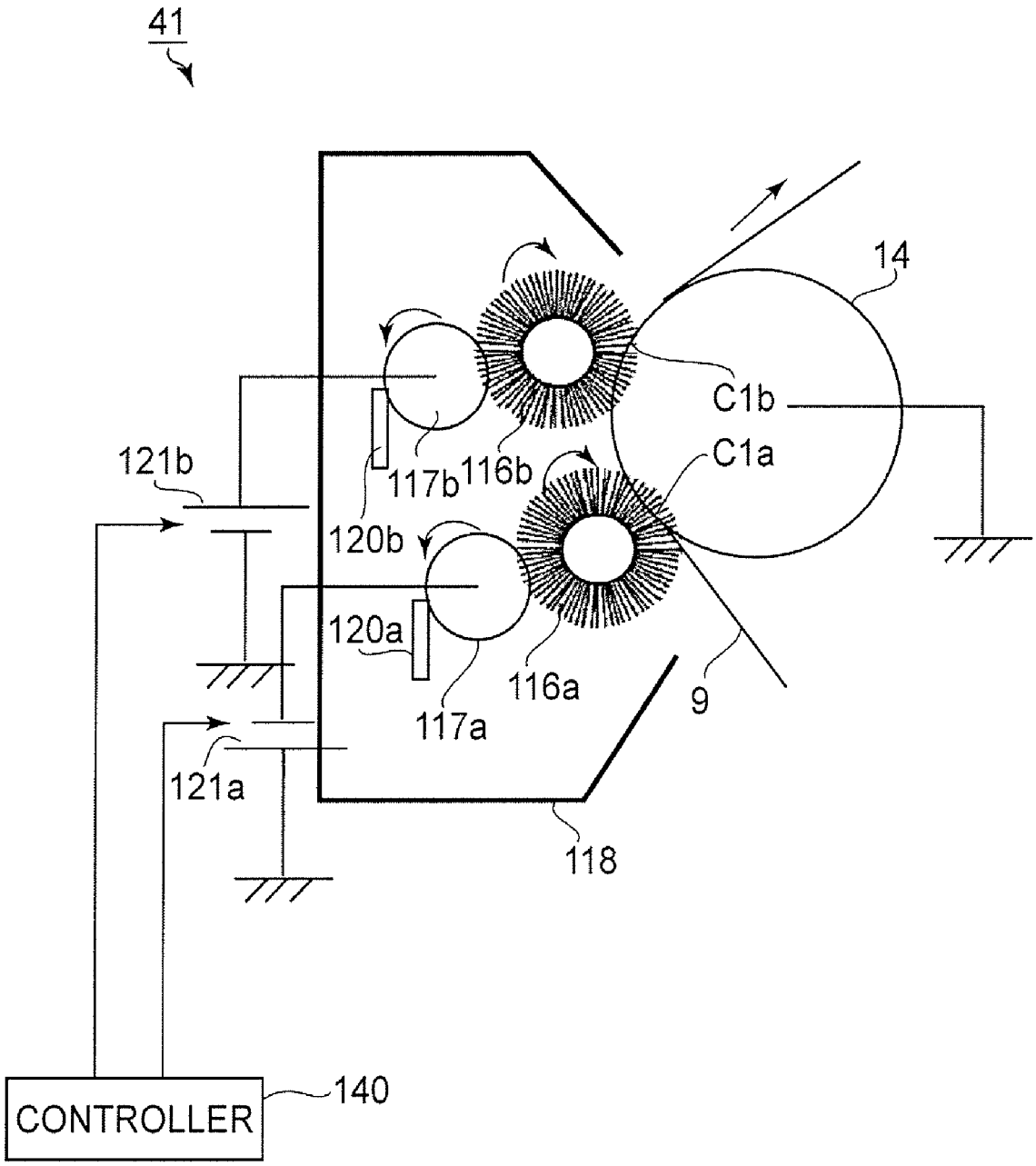
FIG. 2 is a schematic view for illustrating a constitution of a cleaning apparatus.
Figure 3:
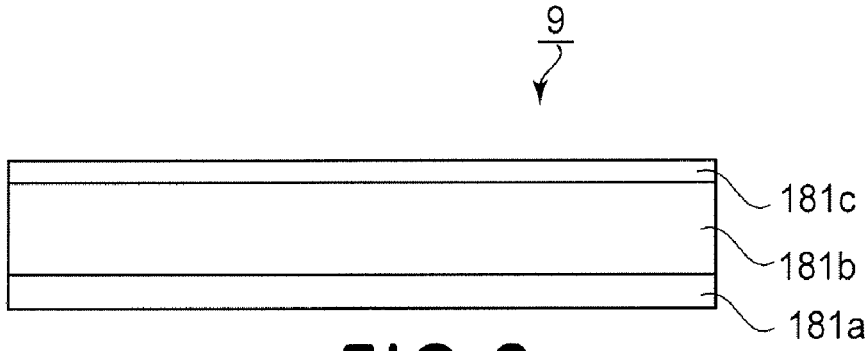
FIG. 3 is a schematic sectional view for illustrating a structure of an intermediary transfer belt.
Figure 4:
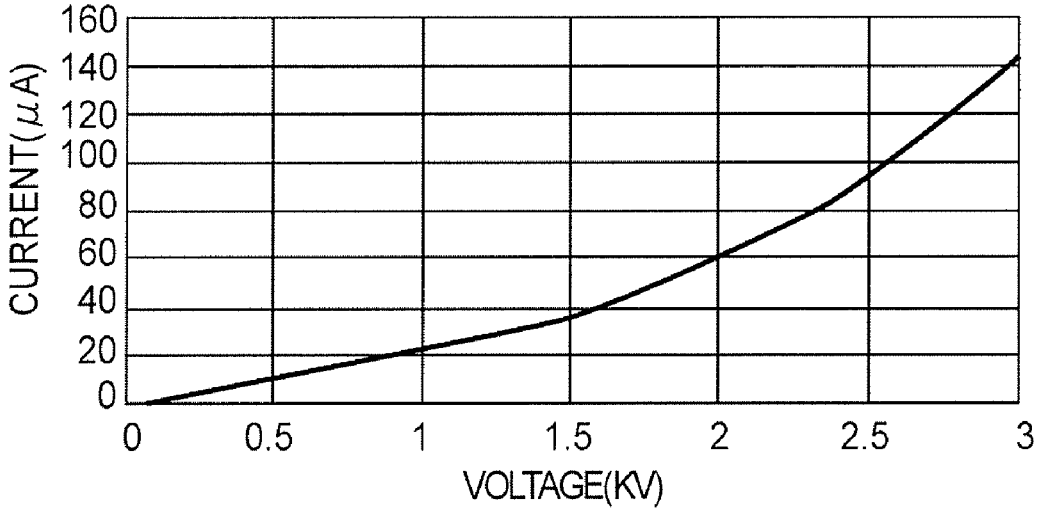
FIG. 4 is a graph showing a relationship between a bias voltage and a cleaning current.
Figure 5:
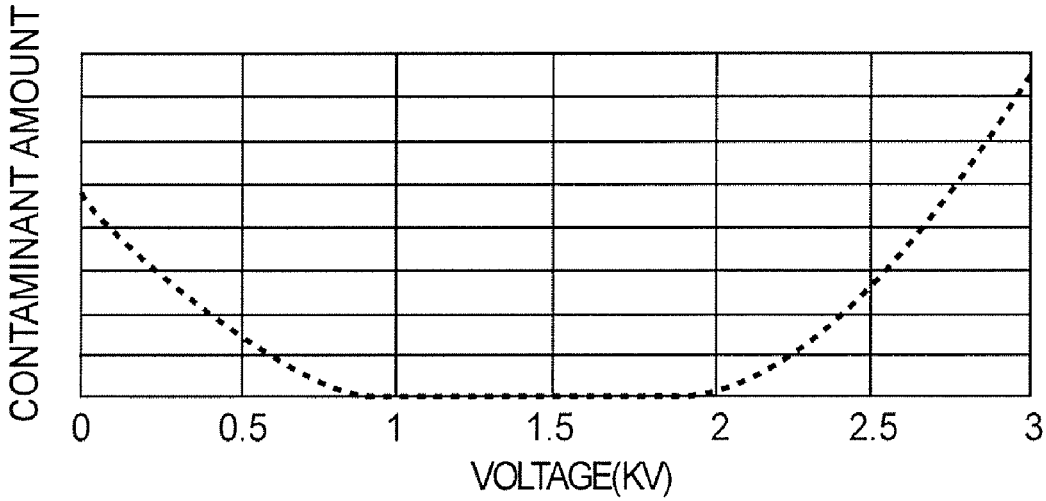
FIG. 5 is a graph showing a relationship between a bias voltage and a cleaning effect.

FIG. 1 is an explanatory view of a schematic constitution of an image forming apparatus of First Embodiment; FIG. 2 is an explanatory view of a schematic constitution of a cleaning apparatus; FIG. 3 is an explanatory view of a cross-sectional constitution of an intermediary transfer belt; FIG. 4 is a graph showing a relationship between a bias voltage and a cleaning current; and FIG. 5 is a graph showing a relationship between the bias voltage and a cleaning effect.

Referring to FIG. 1, in an image forming apparatus 100 of First Embodiment, four color toner images (primary color toner images) formed on a photosensitive drum 1 are primary-transferred onto a intermediary transfer belt 9 in a superposition manner. The resultant full-color toner images formed on the intermediary transfer belt 9 are then secondary-transferred collectively onto a transfer material 40.

The photosensitive drum 1 is an electrostatic image bearing member for being rotated in a direction of an indicated arrow A. On a surface of the photosensitive drum 1 which has been electrically charged uniformly by a charging apparatus 2, an electrostatic latent image corresponding to image information is formed by a known electrophotographic process using an exposure apparatus 3 or the like for effecting light exposure on the basis of the image information.

Around the photosensitive drum 1, a developing unit 8 including developing devices 4, 5, 6 and 7 adapted for development of colors of yellow (Y), magenta (M), cyan (C), and black (B), respectively, is provided.

The electrostatic latent images of the respective primary colors formed on the photosensitive drum 1 are developed by corresponding developing devices 4, 5, 6 and 7 into toner images.

In this embodiment, the photosensitive drum 1 is negatively chargeable and the development is performed by a reversal developing method. Accordingly, all the toners used are of negatively chargeable type.

The intermediary transfer belt 9 is an endless belt extended and stretched along a plurality of stretching rollers 10, 11, 12, 13 and 14 so as to contact the surface of the photosensitive drum 1 and is moved in a direction of an indicated arrow B. The stretching rollers 10 and 11 are metal-made follower rollers disposed in the neighborhood of a primary transfer position between the photosensitive drum 1 and the intermediary transfer belt 9 so as to form a flat primary transfer surface on the intermediary transfer belt 9.

The stretching roller 12 is a tension roller for controlling a tension of the intermediary transfer belt 9 so that the tension is a constant value. The stretching roller 14 is a drive roller for the intermediary transfer belt 9. The stretching roller 13 is an inner secondary transfer roller for secondary-transferring the toner image on the intermediary transfer belt 9 onto the transfer material 40. A secondary transfer roller 16 pressed against the stretching roller via the intermediary transfer belt 9 is an outer secondary transfer roller grounded for effecting secondary transfer. Further, the stretching rollers 10, 11, 12 and 14 are also grounded.

The intermediary transfer belt 9 is an elastic intermediary transfer belt for improving a transferability of the toner onto the transfer material 40. In many cases, the elastic intermediary transfer belt ordinarily has a surface roughness (ten-point average roughness) Rz of 1 μm or more. When a material for the intermediary transfer belt has a surface roughness Rz of more than 1 μm, it is difficult to completely remove a transfer residual toner by blade cleaning for scraping the toner with a cleaning blade. For this reason, a cleaning method for electrostatically removing the transfer residual toner using a cleaning brush instead of the cleaning blade is employed.

A cleaning apparatus 41 disposed, opposite to the stretching roller 14, between a primary transfer portion and a secondary transfer portion T2 where the secondary transfer is effected electrostatically removes the secondary transfer residual toner on the intermediary transfer belt 9 by using the cleaning brush. In this embodiment, an area in which the secondary transfer residual toner is present is referred to as an "image area".

The cleaning apparatus 41 includes, as shown in FIG. 2, a pair of fur-like electroconductive brushes 116*a* and 116*b* in an apparatus housing 118.

The electroconductive brushes 116*a* and 116*b* rotate in contact with metal rollers 117*a* and 117*b*, respectively. To the metal rollers 117*a* and 117*b*, bias voltages of opposite polarities are supplied from DC power sources 121*a* and 121*b*, respectively. An upstream-side electroconductive brush 116*a* is supplied with a negative (−) bias voltage, and a downstream-side electroconductive brush 116*b* is supplied with a positive (+) bias voltage.

The bias voltage applied to the metal roller 117*a* is divided by a series circuit consisting of the electroconductive brush 116*a*, the intermediary transfer belt 9, and the stretching roller 14. A toner collected on a brush of the electroconductive brush 116*a* electrostatically moves to a surface of the metal roller 117*a* having a higher (negative) voltage. The toner carried on the surface of the metal roller 117*a* is scraped off the metal roller 117*a* by a cleaning blade 120*a* caused to contact the metal roller 117*a*.

Accordingly, the secondary transfer residual toner which has been positively charged on the intermediary transfer belt 9 is electrostatically removed or collected from the intermediary transfer belt 9 to the electroconductive brush 116*a* and then is electrostatically moved from the electroconductive brush 116*a* to the metal roller 117*a*. Finally, the secondary transfer residual toner is completely removed from the metal roller 117*a* by the cleaning blade 120*a*.

The bias voltage applied to the metal roller 117*b* is divided by a series circuit consisting of the electroconductive brush 116*b*, the intermediary transfer belt 9, and the stretching roller 14. A toner collected on a brush of the electroconductive brush 116*b* electrostatically moves to a surface of the metal roller 117*b* having a higher (positive) voltage. The toner carried on the surface of the metal roller 117*b* is scraped off the metal roller 117*b* by a cleaning blade 120*b* caused to contact the metal roller 117*b*.

Accordingly, the residual toner which has been negatively charged on the intermediary transfer belt 9 is electrostatically removed or collected from the intermediary transfer belt 9 to the electroconductive brush 116*b* and then is electrostatically moved from the electroconductive brush 116*b* to the metal roller 117*b*. Finally, the secondary transfer residual toner is completely removed from the metal roller 117*b* by the cleaning blade 120*b*.

The intermediary transfer belt 9 is the elastic intermediary transfer belt having an elastic layer. As shown in FIG. 3, the intermediary transfer belt 9 has a three-layer structure including a resinous layer 181*a* for ensuring a tensile strength, an elastic layer 181*b* for imparting a surface elasticity, and a surface layer 181*c* for adjusting a surface property, which are laminated in this order.

As a resinous material constituting the resinous layer 181*a*, it is possible to use one species or two or more species of resins selected from the group consisting of polycarbonate; fluorine-containing resins (ETFE, PVDF); styrene-based resins (styrene- or substituted styrene-containing homopolymers or copolymers) such as polystyrene, polychlorostyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methylacrylate copolymer, styrene-ethylacrylate copolymer, styrene-butyl acrylate copolymer, styrene-octylacrylate copolymer, styrene-phenylacrylate copolymer, etc.), styrene-methacrylate copolymers (styrene-methylmethacrylate copolymer, styrene-ethyl-methacrylate copolymer, styrene-phenylmethacrylate copolymer, etc.), styrene-α-methylchloroacrylate copolymer, and styrene-acrylonitrile-acrylate copolymer; methyl methacrylate resin; butyl methacrylate resin; ethyl acrylate resin; butyl acrylate resin; modified acrylate resins (silicone-modified acrylic resin, vinyl chloride resin-modified acrylic resin, acrylic urethane resin, etc.); vinyl chloride resin; styrene-vinyl acetate copolymer; vinyl chloride acetate copolymer; rosin-modified maleic resin; phenolic resin; epoxy resin; polyester resin; polyester polyurethane resin; polyethylene; polypropylene; polybutadiene; polyvinylidene chloride; ionomer resin; polyurethane resin; silicone resin; ketone resin; ethylene-ethyl acrylate copolymer; xylene resin; polyvinyl butyral resin; polyamide resin; polyimide resin; modified-polyphenylene oxide resin; modified polycarbonate; and the like. However, the resinous material is not limited to the above described materials.

As an elastic material (elastic rubber, elastomer) constituting the elastic layer 181*b*, it is possible to use one species or two or more species of rubbers or elastomers selected from the group consisting of butyl rubber, fluorine-containing rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluororubber, polysulfide rubber, polynorbornene rubber, hydrogenated nitrile rubber, and thermoplastic elastomers (of polyethylene-type, polyolefine-type, polyvinyl chloride-type, polyurethane-type, polyamide-type, polyurethane-type, polyester-type, and fluorine-containing resin type), and the like. However, the elastic material is not limited to the above described materials.

A material for the surface layer 181*c* is not particularly limited but is required to decrease a deposition force of toner on the surface of the intermediary transfer belt 9 and enhance a secondary transferability of toner onto the surface of the intermediary transfer belt 9. For example, one species of the resinous materials such as polyurethane, polyester, epoxy resin, and the like or two or more species of the elastic materials selected from the group consisting of elastic materials (elastic rubber, elastomer), butyl rubber, fluorine-containing rubber, acrylic rubber, EPDM, NBR, acrylonitrile-butadiene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, and urethane rubber may be used in combination with a material for decreasing surface energy and enhancing lubricity, dispersed in the resinous or elastic material, such as powders or particles including fluorine-containing resin, fluorine-containing compound, fluorocarbon, titanium dioxide, silicon carbide, etc. These powders or particles can be used singly, in mixture of two or more species, or in a form of different particle sizes.

To the resinous layer 181*a* or the elastic layer 181*b*, an electroconductivity-imparting agent for adjusting a resistivity may be added. The electroconductivity-imparting agent is not particularly limited but may, e.g., include an electroconductive metal oxide such as carbon black, graphite, metal powder (alumina powder, nickel powder, etc.), tin oxide, titanium oxide, antimony oxide, indium oxide, potassium titanate, antimony oxide-tin oxide compound oxide (ATO), indium oxide-tin oxide compound oxide (ITO), etc. These electroconductive metal oxides may also be those surface coated with insulating fine particles of barium sulfate, magnesium silicate, calcium carbonate, etc. However, the electroconductivity-imparting agent is not limited to those described above.

In First Embodiment, thicknesses of the resinous layer 181*a*, the elastic layer 181*b*, and the surface layer 181*c* are 100 μm, 200 μm and 5 μm, respectively. When a transferability is taken into consideration, the intermediary transfer belt 9 may desirably have a volume resistivity ρ (Ωcm) satisfying $10^{5} \leqq \rho \leqq 10^{15}$ (use of a probe according to JIS-K6911, applied voltage of 100 V, application time of 60 sec, 23° C. and 50% RH). In First Embodiment, the volume resistivity of the intermediary transfer belt 9 is $10^{9}$ (Ωcm) (use of a probe according to JIS-K6911, applied voltage of 100 V, application time of 60 sec, 23° C. and 50% RH).

As shown in FIG. 1, at a primary transfer position where the intermediary transfer belt 9 is opposed to the photosensitive drum 1, on the back surface of the intermediary transfer belt 9, the primary transfer roller 15 is disposed. By applying a primary transfer bias HV1 of a positive polarity opposite to a charge polarity of the toner from a transfer bias power source 15P to the primary transfer roller 15, the toner image on the photosensitive drum 1 is primary-transferred onto the intermediary transfer belt 9.

After the primary transfer, a primary transfer residual toner remaining on the surface of the photosensitive drum 1 is removed by a photosensitive drum cleaning apparatus 49 having a cleaning blade of an urethane rubber or the like.

On the other hand, the toner image transferred onto the intermediary transfer belt 9 is secondary transferred onto the transfer material 40 at a secondary transfer nip created between the intermediary transfer belt 9 and the secondary transfer roller 16. In the secondary transfer nip, the transfer material 40 is timely sent from registration rollers 17, the transfer material 40 onto which the toner image is secondary-transferred is conveyed to an unshown fixing device to be heated and pressed, so that the toner image is melt-fixed on the transfer material 40.

The secondary transfer roller 16 has a layer structure consisting of two or more layers including an ion-conductive elastic rubber layer of an urethane rubber or the like and a coating layer. The elastic rubber layer comprises a foamed layer which has a cell diameter of 0.05-1.0 mm and contains carbon black dispersed therein. The surface layer is formed of a fluorine-containing resin-based material in a thickness of 0.1-1.0 mm and contains an ion-conductive polymer dispersed therein. The secondary transfer roller 16 has a surface hardness of 35 degrees as ASKER-C hardness.

Further, in view of a secondary transferability, the secondary transfer roller 16 may desirably have an electric resistance R (Ω) satisfying $10^6 \leqq R \leqq 10^9$ (as measured by applying 2 KV to the secondary transfer roller 16 rotating at 20 rpm in contact with a metal roller (20 mm in diameter) under a total pressure of 9.8N). The First Embodiment, the secondary transfer roller 16 having the electric resistance of $10^7$(Ω) is used.

The cleaning apparatus 41 for removing or collecting the secondary transfer residual toner remaining on the intermediary transfer belt 9 after the secondary transfer is disposed in the neighborhood of the intermediary transfer belt 9 as shown in FIG. 2. In the cleaning apparatus 41, a first cleaning portion using the electroconductive brush 116*a* and a second cleaning portion using the electroconductive brush 116*b* are only different in polarity of bias voltage and are constituted by a common member. Accordingly, in the following description, only the member for the first cleaning member will be described and an explanation of that for the second cleaning portion will be omitted.

The electroconductive brush 116*a* is a fur brush including a metal roller on which carbon dispersed type nylon fibers having an electric resistance of $10^7$Ω and a fineness of 6 denier are planted at a planting density of $50\times10^4$ fibers/square inch. The electric resistance value is measured by applying 100 V to the electroconductive brush 116*a* in a state in which the electroconductive brush 116*a* is caused to enter the metal roller 117 in a penetration depth 1 mm and is rotated at 100 rpm. The electroconductive brush 116*a* is frictionally disposed against the intermediary transfer belt 9 while keeping the penetration depth of about 1 mm and is rotationally moved in a direction of an indicated arrow at a peripheral speed of 50 mm/sec by an unshown drive motor. The metal roller 117*a* is disposed to keep the penetration depth of about 1 mm with respect to the electroconductive brush 116*a* and is rotationally driven in a direction of an indicated arrow at the same peripheral speed as that of the electroconductive brush 116*a*. A cleaning blade 120 abutting against the metal roller 117*a* is formed of an urethane rubber and is disposed to keep the penetration depth of 1 mm with respect to the metal roller 117*a*.

To the metal roller 117*a* connected to the upstream side electroconductive brush 116*a*, a constant bias voltage of a negative (−) polarity identical to that of the toner is applied from a DC power source 121*a*. To the metal roller 117*b* connected to the downstream-side electroconductive brush 116*b*, a constant bias voltage of a positive (+) polarity opposite to that of the toner is applied from a DC power source 121*b*.

By applying the bias voltage to the metal roller 117*a*, a potential difference is created between the intermediary transfer belt 9 and the electroconductive brush 116*a*. A positive toner component present in the secondary transfer residual toner on the intermediary transfer belt 9 is removed or collected by the electroconductive brush 116*a* and a negative toner component present in the secondary transfer residual toner on the intermediary transfer belt 9 is removed or collected by the electroconductive brush 116*b*. The cleaning operation is performed in a cleaning area C1*a* where the electroconductive brush 116*a* contacts the intermediary transfer belt 9. The removed toner is transferred from the electroconductive brush 116*a* onto the metal roller 117*a* by the potential difference between the metal roller 117*a* and the electroconductive brush 116*a* and is scraped off the metal roller 117*a* by the cleaning blade 120*a*.

Here, setting of the bias voltages applied to the cleaning apparatus 41 in First Embodiment will be described more specifically.

FIG. 4 shows a measurement result of a cleaning current during application of a variable bias voltage to the metal roller 117*b* in the constitution of First Embodiment. The cleaning current is a current flowing between the electroconductive brush 116 and the secondary transfer belt (intermediary transfer belt) 9.

The electroconductive brush 116*b* used during the measurement has an electric resistance of $10^7$Ω (equal to that of the electroconductive brush 116*a*), and the intermediary transfer belt 9 has the volume resistivity of $10^9$ (Ωcm) as described above. The resultant current-voltage curves on the positive side and the negative side are substantially identical to each other, so that the current-voltage curve on the positive side is representatively shown in FIG. 4, wherein an abscissa represents an applied voltage (V) and an ordinate represents a measured current (μA).

As shown in FIG. 4, a relationship between the voltage and the current in the area between the electroconductive brush 116*b* and the intermediary transfer belt 9 is as follows. When the voltage applied to the metal roller 117*b* is increased, the current flowing between the fur brush and the intermediary transfer belt is linearly increased from the origin point to a point corresponding to a voltage value exceeding 1.5 kV. From the point, the current is considerably increased. This may be attributable to such a phenomenon that electric discharge starts between the surface of the electroconductive brush 116*b* and the surface of the intermediary transfer belt 9 to considerably increase an amount of current flowing between the electroconductive brush 116*b* and the intermediary transfer belt 9. Such a voltage at which the current value increment is changed largely is referred to as an "(electric) discharge start voltage".

Next, a result of study on a cleaning performance of the electroconductive brush 116*b* with respect to the secondary transfer residual toner remaining on the intermediary transfer belt 9 will be described.

FIG. 5 shows the cleaning performance for the residual toner on the intermediary transfer belt 9 when the voltage applied to the electroconductive brush 116*b* in the constitution of First Embodiment is changed.

In a specific experiment, under a condition providing a transfer efficiency of 90%, a first transfer material 40 is subjected to image formation and secondary transfer and then a secondary transfer residual toner remaining on the intermediary transfer belt 9 is removed by the electroconductive brush 116*b*. Thereafter, under a condition providing a solid white image, a second transfer material 40 is subjected to image formation and secondary transfer and a density of cleaning failure toner transferred onto the white image is measured by a spectrodensitometer (mfd. by X-Rite Inc.). A difference in density between a portion where the image is formed on the first transfer material 40 and a portion where there is no image on the first transfer material 40 is evaluated as a contaminant amount shown in FIG. 5.

Accordingly, if the secondary transfer residual toner on the intermediary transfer belt 9 is completely removed, the contaminant amount is zero. In FIG. 5, the contaminant amount is taken as an ordinate. An abscissa represents an applied voltage which representatively shows a positive-polarity voltage applied to the downstream-side electroconductive brush 116*b* since absolute values of applied voltages to the upstream-side electroconductive brush 116*a* and the donwstream-side electroconductive brush 116*b* are identical to each other during the study on the cleaning performance.

Further, a transfer efficiency (T) during the secondary transfer is represented by a ratio (t1/t2) of a coverage (t1) of toner secondary-transferred from the intermediary transfer belt 9 onto the transfer material 40 to a coverage (t2) of toner of an image originally carried on the intermediary transfer belt 9.

As shown in FIG. 5, it has been found that the secondary transfer residual toner is completely removed at a voltage, close to 1 KV, applied to the metal roller 117*b* and then is deposited again on the intermediary transfer belt 9 at a voltage close to 2 KV. Further, when the result shown in FIGS. 4 and 5 are taken into consideration in combination, it has been found that the electric discharge start voltage and a voltage at which the cleaning failure starts again are almost coincident with each other.

Further, when the polarity of the toner discharged again on the intermediary transfer belt 9 due to the cleaning failure caused at a voltage close to 2 KV is confirmed, the toner discharged from the upstream-side electroconductive brush 116*a* has the negative (−) polarity identical to that of the electroconductive brush 116*a* and the toner discharged from the downstream-side electroconductive brush 116*b* has the positive (+) polarity identical to that of the electroconductive brush 116*b*.

In the image forming apparatus 100 of First Embodiment, by utilizing the above described experimental results, the toner accumulated on the electroconductive brushes 116*a* and 116*b* are discharged therefrom to the intermediary transfer belt 9.

Referring again to FIG. 2, a control portion 140 causes the re-deposition start voltage of 2 kV or more (or −2 kV or less) to be outputted from the DC power source 121*b* (or 121*a*). In other words, when a non-image area (in which the toner image is not formed and there is no secondary transfer residual toner) of the intermediary transfer belt 9 is located in the cleaning area C1*a*, the re-deposition start voltage is applied to the electroconductive brush (fur brush) 116*a*. Similarly, when the non-image area of the intermediary transfer belt 9 is located in a cleaning area C1*b*, the re-deposition start voltage is applied to the electroconductive brush (fur brush) 116*b*.

As described above, absolute values of the voltages applied to the electroconductive brushes 116*a* and 116*b* for discharging the toner accumulated on the electroconductive brushes 116*a* and 116*b* toward the intermediary transfer belt 9 are equal to or larger than those of the discharge start voltages.

As a result, it is possible to remove the toner components, having a small amount of electric charge, accumulated on the electroconductive brushes 116*a* and 116*b*.

In this embodiment, the toner discharged from the upstream-side electroconductive brush 116*a* is collected again by the downstream-side electroconductive brush 116*b*. Further, the toner discharged from the downstream-side electroconductive brush 116*b* is moved to the photosensitive drum 1 by the primary transfer bias voltage HV1 at the primary transfer portion and is completely removed by the photosensitive drum cleaning apparatus 49. The toner discharged from the electroconductive brush 116*b* is positively charged, so that the toner is moved toward the photosensitive drum 1 by applying or ordinary transfer bias voltage HV to the toner at the primary transfer portion.

In the experiment shown in FIG. 5, when the voltage at the time of discharging the toner is excessively increased, the electric discharge phenomenon is caused to occur also in the electroconductive brush 116*b*. As a result, the toner portion accumulated at a deep portion of the electroconductive brush 116*b* is also electrically charged reversely and is discharged therefrom during a subsequent ordinary cleaning operation. By this experiment, it has been found that an upper limit voltage applied to the electroconductive brush may preferably be approximately 2 kV higher than the discharge start voltage.

When voltages applied to the electroconductive brushes 116*a* and 116*b* for discharging the toner are taken as Va and Vb, respectively, and the discharge start voltage is taken as Vs, these voltage values Va, Vb and Vs satisfy the following relationships:

$$|Vs|<|Va|<|Vs|+2\text{ KV, and}$$

$$|Vs|<|Vb|<|Vs|+2\text{ KV.}$$

From the above results, in First Embodiment, the control portion 140 sets the applied voltage values of the intermediary transfer belt 9 to which the secondary transfer residual toner is discharged during the cleaning so that they are −1.3 KV on the upstream side and 1.3 KV on the downstream side. Then, during post-rotation of the intermediary transfer belt 9 after completion of the printing (image formation) job, the control portion 140 sets the voltage values of 2.5 KV on the upstream side and 2.5 KV on the downstream side to effect cleaning of the electroconductive brushes 116*a* and 116*b*.

An experimental result of a continuous image forming test in the image forming apparatus of First Embodiment is shown in Table 1. In Comparative Embodiment 1 in Table 1, the applied voltage values are always −1.3 KV on the upstream side and 1.3 KV during both of the cleaning and post-rotation of the intermediary transfer belt 9.

TABLE 1

| | (Cleaning performance) | |
|---|---|---|
| | First Emb. | Comp. Emb. 1 |
| Initial | Good | Good |
| After $1 \times 10^5$ sheets | Good | Good |
| After $3 \times 10^5$ sheets | Good | Good |

As shown in Table 1, at the initial stage of the cleaning, the electroconductive brushes 116*a* and 116*b* are not clogged with the toner, so that it is possible to perform the cleaning in either case. However, when the number of sheets subjected to image formation is increased and the toner is accumulated on or in the electroconductive brushes 116*a* and 116*b*, in Comparative Embodiment 1, the cleaning ability is lowered during removal of the secondary transfer residual toner. Then, the accumulated toner is discharged from the electroconductive brush to contaminate a subsequent toner image or transfer material.

Second Embodiment

Figure 6:
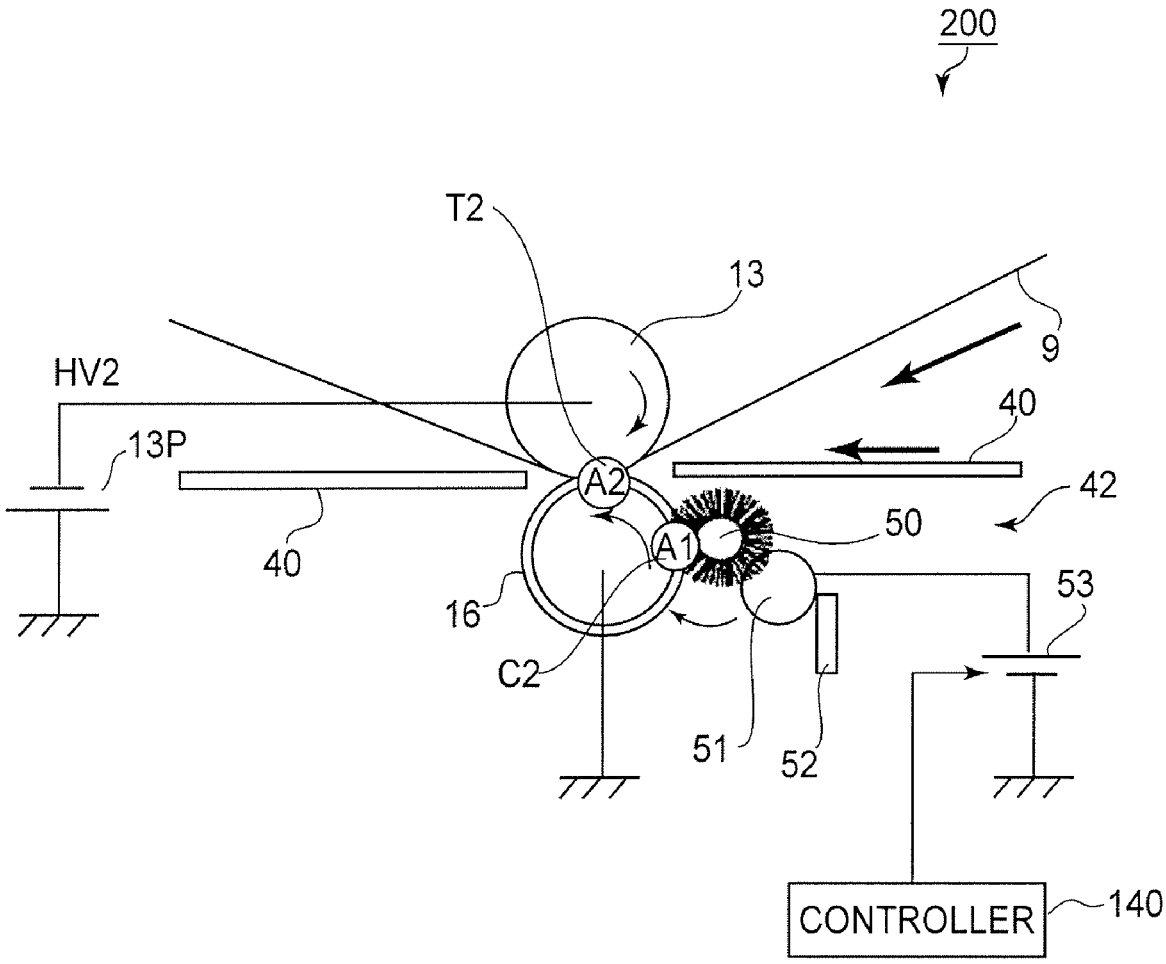
FIG. 6 is an enlarged view of a secondary transfer portion in an image forming apparatus according to Second Embodiment of the present invention.
Figure 7:
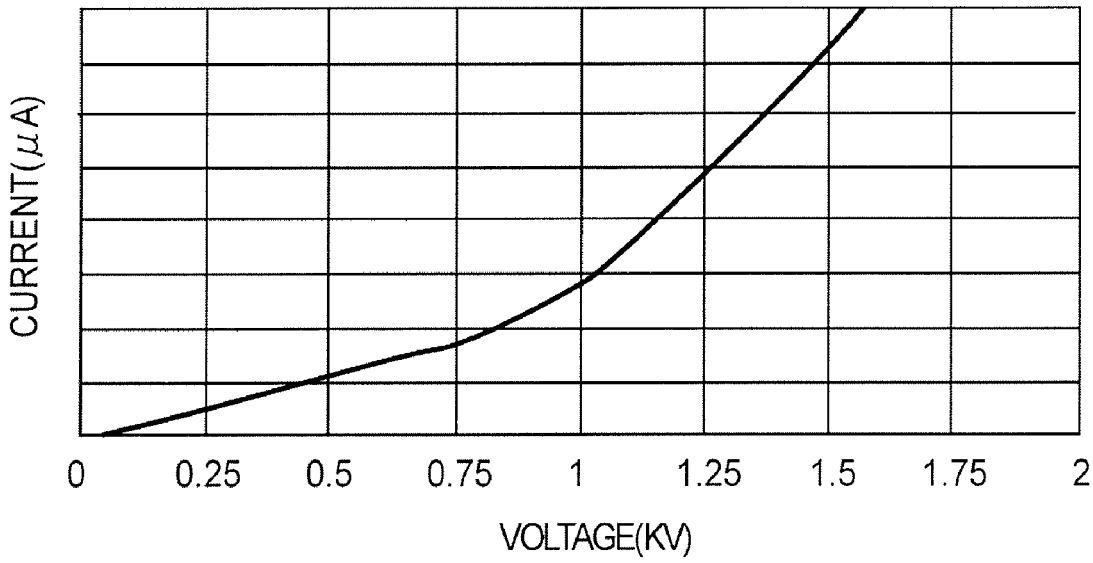
FIG. 7 is a graph showing a relationship between a bias voltage and a cleaning current.
Figure 8:
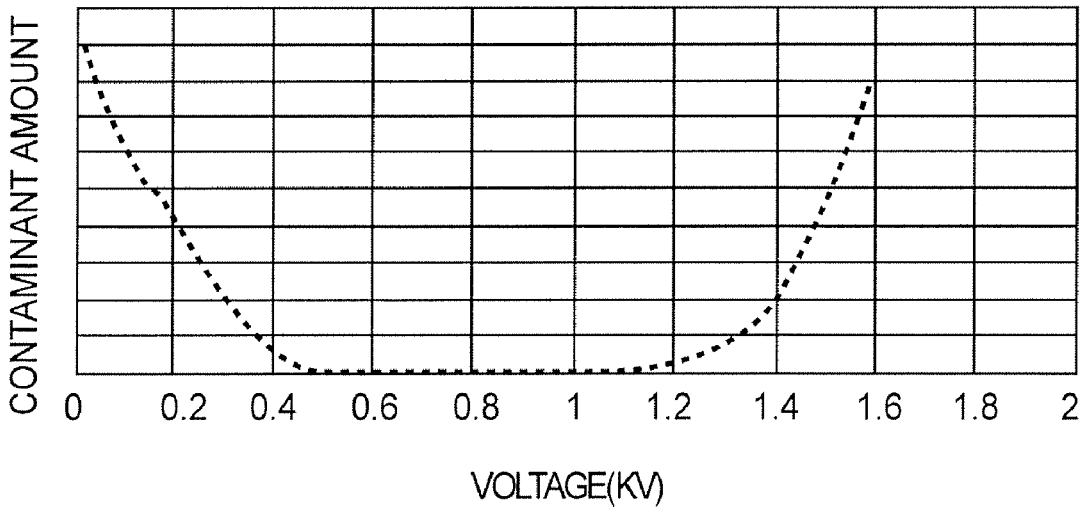
FIG. 8 is a graph showing a relationship between a bias voltage and a cleaning effect.
Figure 9:
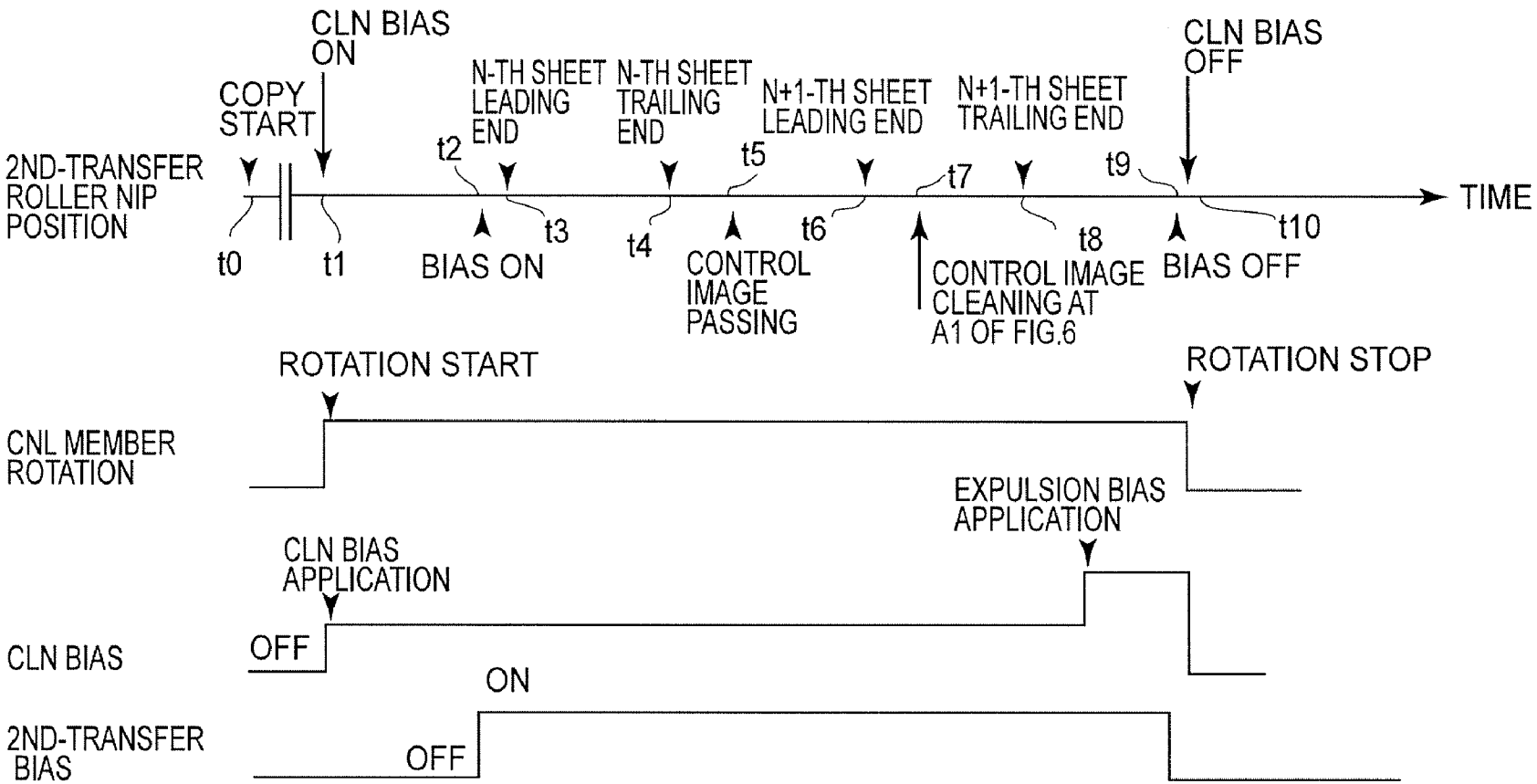
FIG. 9 is a time chart of bias voltage control in Second Embodiment.

FIG. 6 is an enlarged view of a secondary transfer portion of an image forming apparatus according to Second Embodiment. FIG. 7 is a graph showing a relationship between a bias voltage and a cleaning current, FIG. 8 is a graph showing a relationship between the bias voltage and a cleaning effect, and FIG. 9 is a time chart of bias voltage control in Second Embodiment.

In Second Embodiment, an image forming apparatus 200 is provided with an electroconductive brush 50 for cleaning the secondary transfer roller 16 shown in FIG. 1. By controlling a bias voltage applied to the electroconductive brush 50, cleaning with the electroconductive brush is effected. An area in which the cleaning is effected by causing the electroconductive brush 50 to contact the secondary transfer roller 16 is a cleaning area C2. Constituents, shown in FIG. 6, common to those shown in FIG. 1 are indicated by the same reference numerals or symbols and detailed explanations thereof will be omitted from the following description.

In recent years, in an image forming apparatus using an electrostatically photographic process, in order to maintain coloring stability, density uniformity, and the like, a technique in which a control image is formed at a non-image portion on an intermediary transfer belt and a reflection density or the like of the image is detected and fed back so as to keep a stable image has been used widely.

It is desirable that the control image is formed at a sheet interval of successive image formation so as not to stop an image forming operation also in order to prevent an occurrence of downtime. For this purpose, as shown in FIG. 6, the control image formed at the sheet interval contacts the secondary transfer roller 16 when the secondary transfer inner roller (stretching roller) 13 is supplied with a secondary transfer bias voltage HV2, so that a large amount of toner of the control image is deposited on the surface of the secondary transfer roller 16. In other words, the secondary transfer roller 16 is contaminated with the toner image of the control image.

Therefore, in Second Embodiment, in the image forming apparatus 200 for effecting control using the control image, a cleaning apparatus 42 actuating on the same principle as that of the cleaning apparatus 41 in First Embodiment is provided to the secondary transfer roller 16.

The secondary transfer roller 16 used in Second Embodiment, as described in First Embodiment, has the ion-conductive elastic rubber layer of an urethane rubber or the like and the coating layer. The elastic rubber layer comprises a foamed layer which has a cell diameter of 0.05-1.0 mm and contains carbon black dispersed therein. The surface layer is formed of a fluorine-containing resin-based material in a thickness of 0.1-1.0 mm and contains an ion-conductive polymer dispersed therein. The secondary transfer roller 16 has a surface hardness of 35 degrees as ASKER-C hardness.

Further, in view of a secondary transferability and a cleaning performance, the secondary transfer roller 16 may desirably have an electric resistance R (Ω) satisfying $10^6 \leqq R \leqq 10^9$ (as measured by applying 2 KV to the secondary transfer roller 16 rotating at 20 rpm in contact with a metal roller 51 (20 mm in diameter) under a total pressure of 9.8N). The Second Embodiment, the secondary transfer roller 16 having the electric resistance of $10^7$(Ω) is used.

The cleaning apparatus 42 provided to the secondary transfer roller 16 has the same constitution a that of the cleaning apparatus 41 provided to the intermediary transfer belt 9 in First Embodiment. From the viewpoint of a surface roughness of a member to be cleaned, the cleaning apparatus 41 may preferably be of a fur brush type, so that a fur brush cleaning apparatus is also employed in Second Embodiment similarly as in First Embodiment.

In the cleaning apparatus 42 in Second Embodiment, the electroconductive brush 50 as a fur brush cleaning member is disposed upstream from the secondary transfer nip. The electroconductive brush 50 has an outer diameter of 20 mm, a fiber length of 5 mm, a penetration depth of 1 mm with respect to the secondary transfer roller 16, a fiber density of $5 \times 10^5$ fibers/square inch, and an electric resistance of $10^7$(Ω). The electric resistance is measured by applying 100 V to the metal roller 51 in a state in which the electroconductive brush 50 is caused to contact the metal roller 51 with the penetration depth of 1 mm and is rotated at 100 rpm.

The electroconductive brush 50 is rotationally driven by an unshown drive motor in a direction opposite from that of the secondary transfer roller 16 at a peripheral speed of 20% of the peripheral speed of the secondary transfer roller 16. The control portion 140 causes a bias voltage of a positive polarity (+) opposite to a polarity of the toner to be outputted from a DC power source 52 during rotation of the secondary transfer roller 16. The positive-polarity (+) bias voltage is applied to the high-resistance secondary transfer roller 16, which has been grounded, through the electroconductive brush 50. Against the metal roller 51, a cleaning blade 52 formed of an urethane rubber for scraping the toner moved to the metal roller 51 is abutted.

FIG. 7 shows a measurement result of a cleaning current flowing between the electroconductive brush 50 and the secondary transfer roller 16 during the application of a variable bias voltage to the metal roller 51. Further, FIG. 8 shows an experimental result of a relationship between the bias voltage and a cleaning performance of the control image on the secondary transfer roller 16.

As shown in FIG. 8, in Second Embodiment, it is possible to completely remove the control image at the bias voltage applied to the electroconductive brush 50 in a range from about 0.5 KV to less than 1.0 KV. Further, at a bias voltage, as an electric discharge start voltage, exceeding a value more than 1.0 KV, it has been confirmed that the toner is discharged again from the surface of the electroconductive brush 50 to the surface of the secondary transfer roller 16.

In the image forming apparatus 200 in Second Embodiment, the control portion 140 controls the DC power source 53 in accordance with the time chart shown in FIG. 9 to effect cleaning of the secondary transfer roller 16 with the electroconductive brush 50.

Referring to FIG. 9, when a job ("COPY") is provided at time t0, a first voltage (CLN high voltage) is applied to the electroconductive brush 50 at time t1. At time t2, a secondary transfer bias voltage (secondary transfer high voltage) is outputted from a DC power source 13P to the stretching roller 13. Between time t3 and time t4, secondary transfer with respect to the transfer material 40 is completed. At time t5, the control image formed at the sheet interval enters the secondary transfer nip in which the toner is deposited on the secondary transfer roller 16. The toner deposited on the secondary transfer roller 16 reaches the electroconductive brush 50 at time t7 at which the toner is removed. During the cleaning (removal), secondary transfer with respect to a subsequent transfer material (recording material) is performed in a period from time t6 to time t8. When secondary transfer with respect to a final recording material is completed at time t8, a second voltage ((toner) discharging bias) is applied to the electroconductive brush 50 to move the toner accumulated on the electroconductive brush 50 to the electroconductive brush 50. Until the second voltage application is terminated at time t10, the accumulated toner is continuously moved to the intermediary transfer belt 9 in the secondary transfer nip. At time t9, the secondary transfer bias voltage (secondary transfer high voltage) application is stopped and at time t10, the first voltage (CLN high voltage) application is also stopped. As a result, the toner accumulated on the electroconductive brush 50 is removed, so that the cleaning performance is restored.

In this embodiment, at least in a period in which the control image passes through an area on the secondary transfer roller 16 during the image forming operation, the control portion 140 controls a DC power source 53 so that a cleaning voltage of 0.7 KV is applied from the DC power source 53 to the metal roller 51. At a nip portion A1 (FIG. 6) between the secondary transfer roller 16 and the electroconductive brush 50, the cleaning operation for the control image is effected.

Further, during post-rotation after the image forming operation, the control portion 140 controls the DC power source 53, at a timing at which there is no toner image, so that a toner discharge operation is performed by applying a voltage of 1.5 KV higher than the ordinary cleaning voltage from the DC power source 53. At this time, to the secondary transfer inner roller (stretching roller) 13, the secondary transfer bias voltage HV2 similar to that in the ordinary secondary transfer operation is applied. As a result, the discharge toner reversed in charge polarity in the nip A1 is moved onto the intermediary transfer belt 9 and can be removed completely by the cleaning apparatus 41 (FIG. 1) provided to the intermediary transfer belt 9.

By using the cleaning sequence shown in FIG. 9, even when the fur brush cleaning apparatus is employed as the cleaning apparatus 42 for the secondary transfer roller 16, it is possible to realize a simple and inexpensive constitution. Further, it is possible to maintain a good cleaning performance for the control image not only at the initial stage but also after continuous image formation.

Third Embodiment

Figure 10:
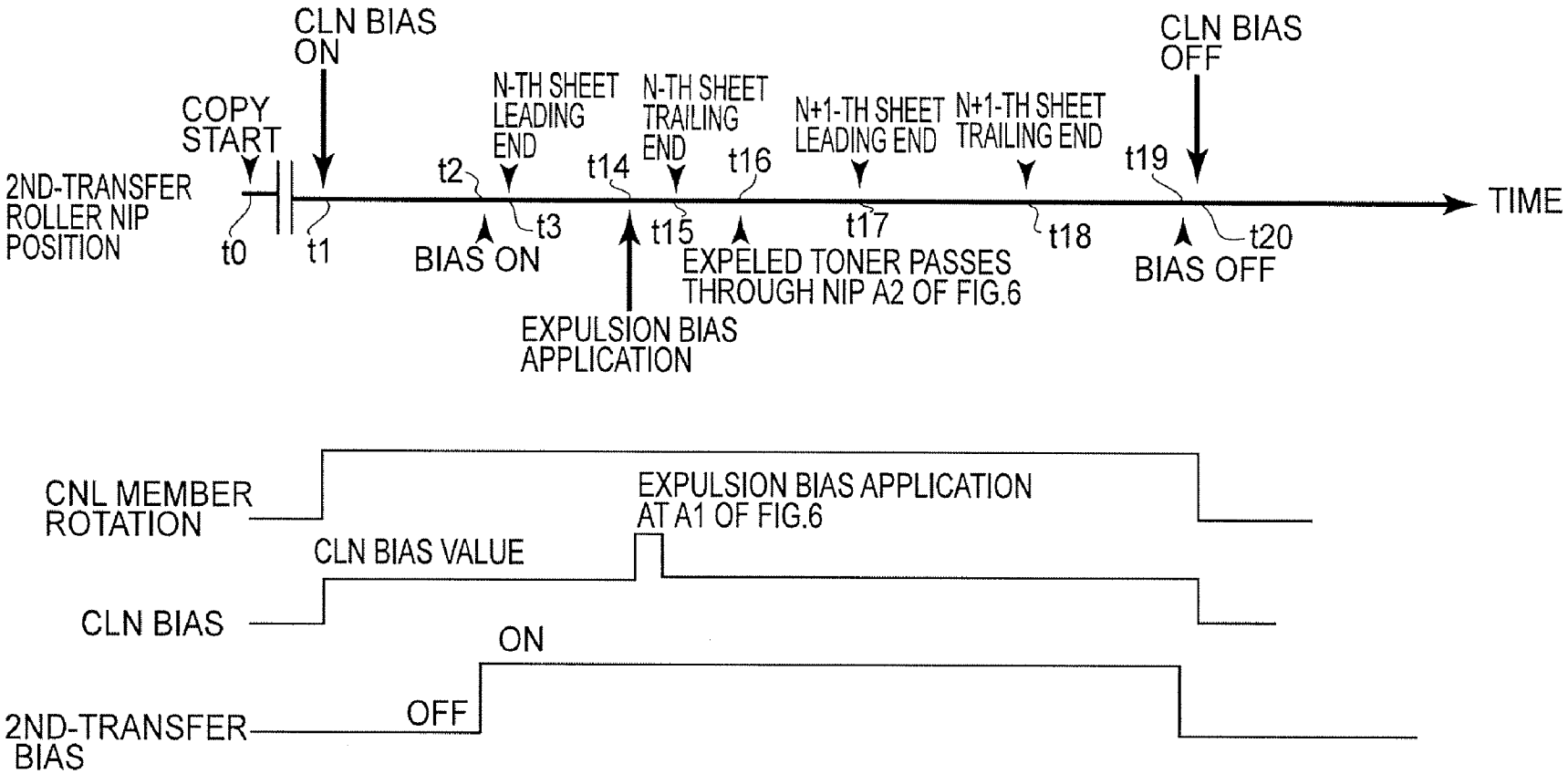
FIG. 10 is a time chart of cleaning control in Third Embodiment.

FIG. 10 is a time chart of cleaning control in Third Embodiment, in which cleaning of the secondary transfer roller 16 is performed in the same constitution as in Second Embodiment but a timing of discharging (expelling) a toner accumulated on the brush member 50 is different from that in Second Embodiment. In Third Embodiment, an image forming apparatus has exactly the same constitution as the image forming apparatus 200 in Second Embodiment, so that a redundant explanation will be omitted unless otherwise needed.

FIG. 9 shows the sequence in the nip between the secondary transfer roller 16 and the brush member 50 in the case where there is no control image in the nip. However, in the case where the image formation is continued by using the intermediary transfer belt 9, the control image is formed also at the sheet interval. In Third Embodiment, the control image formed at the sheet interval and transferred onto the secondary transfer roller 16 is removed by the cleaning apparatus 42.

In Third Embodiment, as shown in FIG. 10, at a timing (time t14) at which the toner moved to the secondary transfer roller 16 by applying the second voltage is moved in the secondary transfer nip where the recording material 40 is located, the second voltage is applied to the brush member 50. The second voltage is changed (returned) to the first voltage at a timing at which the toner moved to the brush member 50 does not adversely affect a subsequent recording material (transfer material). When the transfer material enters the secondary transfer nip at time t13, the second voltage higher in one level than the first voltage is applied to the brush member 50. At time 16 after the recording material has passed through the secondary transfer nip at time t15, the toner discharged (expelled) from the brush member 50 to the secondary transfer roller 16 enters the secondary transfer nip and is collected by the intermediary transfer belt 9. An application time of the second voltage is controlled so that the toner discharged from the brush member 50 to the secondary transfer roller 16 is not deposited on a subsequent recording material 40 which enters the secondary transfer nip at time t17. After the final recording material 40 has passed through the secondary transfer nip at time t18, the application of the secondary transfer bias voltage (secondary transfer high voltage) is terminated at time 19, and then the application of the first voltage (CLN high voltage) is also terminated at time t20.

In Third Embodiment, as shown in FIG. 10, the secondary transfer nip between the intermediary transfer belt 9 and the secondary transfer roller 16 is controlled by applying a pulse-like first voltage (toner expulsion bias). More specifically, the portion A1 (FIG. 6) where second voltage of 1.5 KV is applied to the metal roller 51 is controlled to reach the portion A2 (FIG. 6) at a sheet interval between N-th sheet and N+1-th sheet of the transfer material 40. At timings other than the timing at which the second voltage is applied at the portion A1, an ordinary first voltage of 0.7 KV is applied to the metal roller 51. When there is the control image, similarly as in Second Embodiment, the first voltage is continuously applied during the transfer operation. As a result, it is possible to remove the control image deposited on the secondary transfer roller 16.

According to Third Embodiment, by effecting the control in the above-described manner, there is no need to intentionally provide downtime during continuous image formation and it is possible to achieve an effect similar to that in Second Embodiment. In addition, a productivity is further improved.

<Comparative Image Forming Apparatus>

Figure 11:
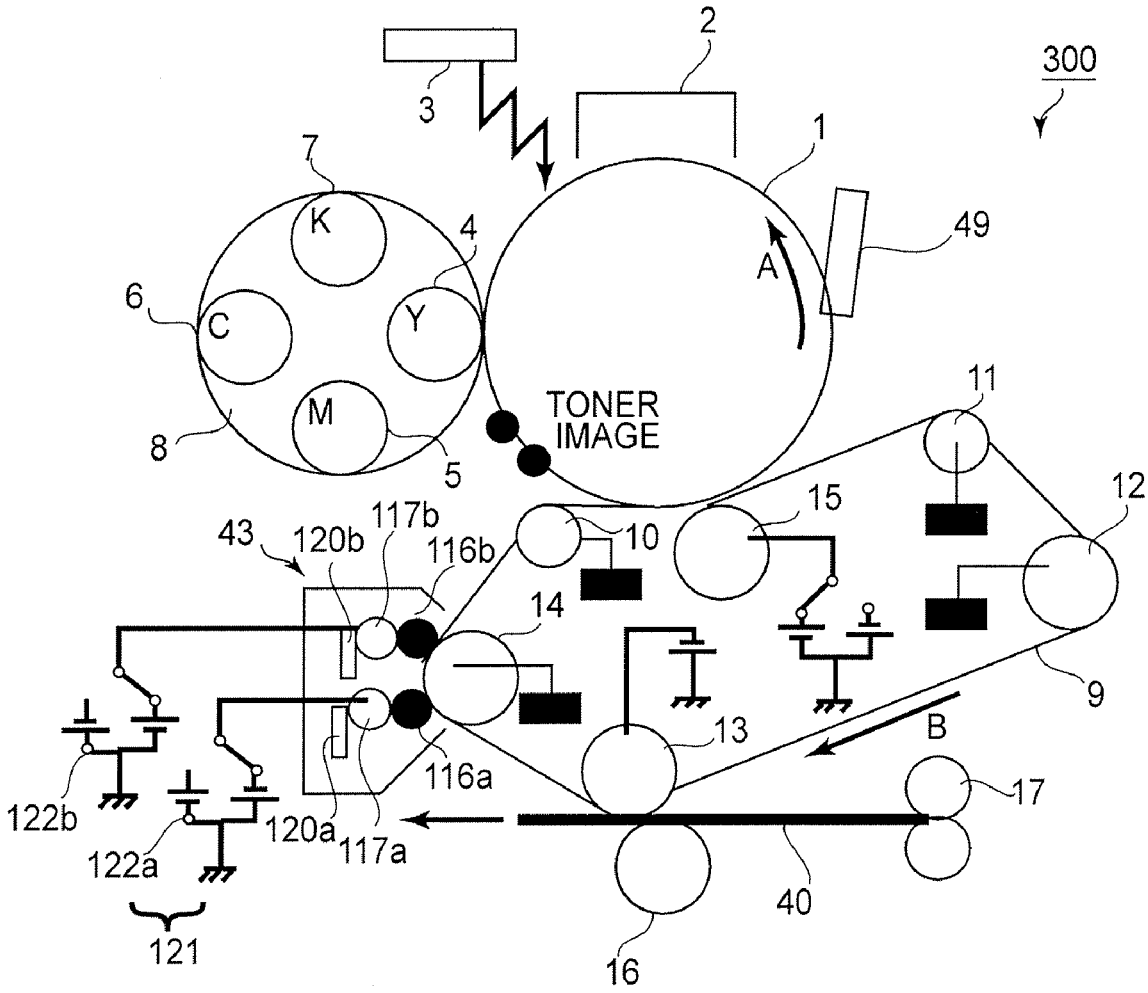
FIG. 11 is a schematic view for illustrating a constitution of an image forming apparatus according to Comparative Embodiment.

FIG. 11 is an explanatory view showing a schematic constitution of an image forming apparatus 300 in Comparative Embodiment. In the comparative image forming apparatus 300, the cleaning apparatus 41 in the image forming apparatus of First Embodiment is replaced with a fur brush cleaning apparatus described in JP-A 2002-72697 and corresponding to the conventional cleaning apparatus described with reference to FIG. 6. Therefore, constituents common to those shown in FIG. 1 are indicated by the same reference numerals or symbols as those indicated in FIG. 1 and a detailed description thereof will be omitted.

As shown in FIG. 11, a cleaning apparatus 43 of the image forming apparatus 300 employs fur-like electroconductive brushes 116*a* and 116*b* rotating in contact with the intermediary transfer belt 9. To these electroconductive brushes 116*a* and 116*b*, bias voltages are supplied from DC power sources 122*a* and 122*b* through metal rollers 117*a* and 117*b*, respectively. Each of the DC power sources 122*a* and 122*b* is capable of outputting high voltages of both (positive and negative) polarities.

During a cleaning period of the intermediary transfer belt 9, a voltage of −1.3 KV is applied to the upstream side electroconductive brush 116*a* and a voltage of 1.3 KV is applied to the downstream-side electroconductive brush 116*b*. However, during a period in which the toners accumulated on the electroconductive brushes 116*a* and 116*b* are discharged, a voltage of 1.3 KV is applied to the upstream side electroconductive brush 116*a* and a voltage of −1.3 KV is applied to the downstream-side electroconductive brush 116*b*.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 099949/2006 filed Mar. 31, 2006, which is hereby incorporated by reference.

What is claimed is:

1. An image forming apparatus comprising:

a rotatable image bearing member for bearing a toner image;

toner image forming means for forming the toner image on said image bearing member;

a transfer member for transferring the toner image formed on said image bearing member onto a transfer material;

a power source for applying a voltage; and a cleaning member for electrostatically collecting toner remaining on said image bearing member after the toner image is transferred onto the transfer material, by being supplied from said power source with a voltage which has an absolute value smaller than an absolute value of an electrical discharge start voltage and which has a preset polarity, wherein said image forming apparatus is capable of discharging toner from said cleaning member by applying, from said power source to said cleaning member, a voltage which has an absolute value equal to or larger than the absolute value of the electrical discharge start voltage and which has an identical polarity to the preset polarity.

2. An apparatus according to claim 1, wherein the toner is discharged from said cleaning member at a time when an image is not being formed.

3. An apparatus according to claim 1, wherein said cleaning member comprises a brush in rotatable contact with said image bearing member.

4. An apparatus according to claim 1, wherein said image forming apparatus further comprises a second cleaning member disposed downstream from said cleaning member with respect to a rotational direction of said image bearing member, and wherein said second cleaning member is configured to electrostatically collect toner remaining on said image bearing member after the toner image is transferred onto the transfer material, by being supplied with a voltage from a power source, wherein the voltage has a polarity opposite to the preset polarity.

5. An apparatus according to claim 4, wherein said image forming apparatus is capable of discharging toner from said second cleaning member by applying a voltage, which has an absolute value equal to or larger than the absolute value of the electrical discharge start voltage, and which has a polarity opposite to the polarity of the electrical discharge start voltage.

6. An apparatus according to claim 4, wherein the toner discharged from said cleaning member is collected by said second cleaning member.

7. An apparatus according to claim 1, wherein said toner image forming means includes an electrophotographic photosensitive member, and said image bearing member is an intermediary transfer member for carrying a toner image transferred from said electrophotographic photosensitive member.

8. An apparatus according to claim 1, wherein the preset polarity is a negativepolarity.

* * * * *